US009700750B2

(12) United States Patent
Banks et al.

(10) Patent No.: US 9,700,750 B2
(45) Date of Patent: Jul. 11, 2017

(54) FITNESS DEVICE AND METHODS OF USE

(71) Applicants: Dominic Banks, Portland, OR (US); Manju Morrissey, Portland, OR (US)

(72) Inventors: Dominic Banks, Portland, OR (US); Manju Morrissey, Portland, OR (US)

(73) Assignee: Star Body LLC, Portland, OR (US)

( * ) Notice: Subject to any disclaimer, the term of this patent is extended or adjusted under 35 U.S.C. 154(b) by 0 days.

(21) Appl. No.: 14/761,607

(22) PCT Filed: Jan. 16, 2014

(86) PCT No.: PCT/US2014/011888
§ 371 (c)(1),
(2) Date: Jul. 16, 2015

(87) PCT Pub. No.: WO2014/113587
PCT Pub. Date: Jul. 24, 2014

(65) Prior Publication Data

US 2015/0360070 A1 Dec. 17, 2015

Related U.S. Application Data

(60) Provisional application No. 61/753,327, filed on Jan. 16, 2013.

(51) Int. Cl.
*A63B 21/02* (2006.01)
*A63B 21/00* (2006.01)
(Continued)

(52) U.S. Cl.
CPC .. *A63B 21/00185* (2013.01); *A63B 21/00043* (2013.01); *A63B 21/026* (2013.01);
(Continued)

(58) Field of Classification Search
CPC . A63B 21/00185; A63B 21/026; A63B 23/04; A63B 23/03541; A63B 23/0405;
(Continued)

(56) References Cited

U.S. PATENT DOCUMENTS 3,411,500 A * 11/1968 Gatts ..... A63B 21/023 600/20
4,245,840 A 1/1981 Van Housen
(Continued)

OTHER PUBLICATIONS

International Search Report and Written Opinion for PCT/US2014/011888 (mailed May 12, 2014).
(Continued)

*Primary Examiner* — Andrew S Lo
*Assistant Examiner* — Megan Anderson
(74) *Attorney, Agent, or Firm* — Klarquist Sparkman, LLP

(57) ABSTRACT

A fitness device comprises a waist belt configured to fit around a user's waist and at least one resilient leg loop member. The resilient leg loop member has a proximal end movably anchored to the waist belt at a posterior position. The resilient leg loop member has an opposite distal end configured for coupling with one of the user's feet. The fitness device causes a predetermined resistance force to be generated against the user's movement when the user extends the leg loop member beyond its length at rest. In some embodiments, two resilient leg loop members are provided. Methods of using the exercise device are also described.

16 Claims, 5 Drawing Sheets

(51) Int. Cl.
*A63B 21/055* (2006.01)
*A63B 23/035* (2006.01)
*A63B 23/04* (2006.01)

(52) U.S. Cl.
CPC ..... *A63B 21/0552* (2013.01); *A63B 21/1419* (2013.01); *A63B 21/1484* (2013.01); *A63B 21/4009* (2015.10); *A63B 21/4015* (2015.10); *A63B 21/4025* (2015.10); *A63B 23/03541* (2013.01); *A63B 23/04* (2013.01); *A63B 23/0405* (2013.01); *A63B 21/0557* (2013.01); *A63B 23/0482* (2013.01); *A63B 2208/0219* (2013.01); *A63B 2209/10* (2013.01)

(58) Field of Classification Search
CPC ..... A63B 23/0482; A63B 21/4009; A63B 21/4025; A63B 21/4015; A63B 21/00043; A63B 21/0552; A63B 21/0557
See application file for complete search history.

(56) References Cited

U.S. PATENT DOCUMENTS 4,685,671 A 8/1987 Hagerman et al.
4,909,505 A * 3/1990 Tee ..... A63B 21/00043 482/121
4,930,767 A * 6/1990 Hamm ..... A63B 21/0552 482/124
5,141,223 A 8/1992 Block
5,336,151 A 8/1994 Van Ballegooie
5,647,827 A 7/1997 Gutkowski et al.
5,653,668 A 8/1997 Wilkinson
5,813,954 A 9/1998 Wilkinson
5,820,534 A 10/1998 Vadher
6,258,014 B1 7/2001 Karecki
6,551,221 B1 4/2003 Marco
6,629,912 B2 10/2003 Downs
7,004,892 B2 * 2/2006 Marco ..... A63B 21/0004 434/258
7,691,041 B2 4/2010 Abdo
7,727,131 B2 6/2010 Longo
9,186,536 B2 * 11/2015 Strachan ..... A63B 21/0557
2002/0068667 A1 6/2002 Strachan
2004/0204302 A1 * 10/2004 Flynn ..... A63B 21/0004 482/124
2009/0062087 A1 3/2009 Poppinga
2010/0279830 A1 11/2010 Snagg
2011/0021329 A1 1/2011 Dunne
2012/0245002 A1 9/2012 Todd

OTHER PUBLICATIONS

Speedy Karate, "Foot Loop Band," http://www.speedykarate.com/footloopband.html (downloaded Jan. 15, 2014).

* cited by examiner

FITNESS DEVICE AND METHODS OF USE

CROSS REFERENCE TO RELATED APPLICATIONS

This is the U.S. National Stage of International Application No. PCT/US2014/011888, filed Jan. 16, 2014, which was published in English under PCT Article 21(2), which in turn claims the benefit of U.S. Provisional Patent Application No. 61/753,327, filed on Jan. 16, 2013, both of which are incorporated by reference herein.

BACKGROUND

Fitness enthusiasts still seek better solutions to achieving their goals. As just one example, conventional approaches to exercising the gluteal and other lower body muscles have drawbacks. Some conventional approaches require use of large machines, but such machines are expensive, occupy significant space and can be difficult and/or intimidating to use. In addition, it can be difficult to achieve the proper resistances and to apply them in the proper directions with current approaches, especially when considering a broad class of users having different statures, abilities, and ranges of motion, to name just a few variables.

SUMMARY

Described below is an exercise device that is portable, effective and overcomes some of the other drawbacks of the conventional approaches.

According to one implementation, the fitness device comprises a waist belt configured to fit around a user's waist and at least one resilient leg loop member. The resilient leg loop member has a proximal end movably anchored to the waist belt at a posterior position. The resilient leg loop member has an opposite distal end configured for coupling with one of the user's feet. The fitness device causes a predetermined resistance force to be generated against the user's movement when the user extends the leg loop member beyond its length at rest.

The foregoing and other objects, features, and advantages of the invention will become more apparent from the following detailed description, which proceeds with reference to the accompanying figures.

DETAILED DESCRIPTION

Figure 1:
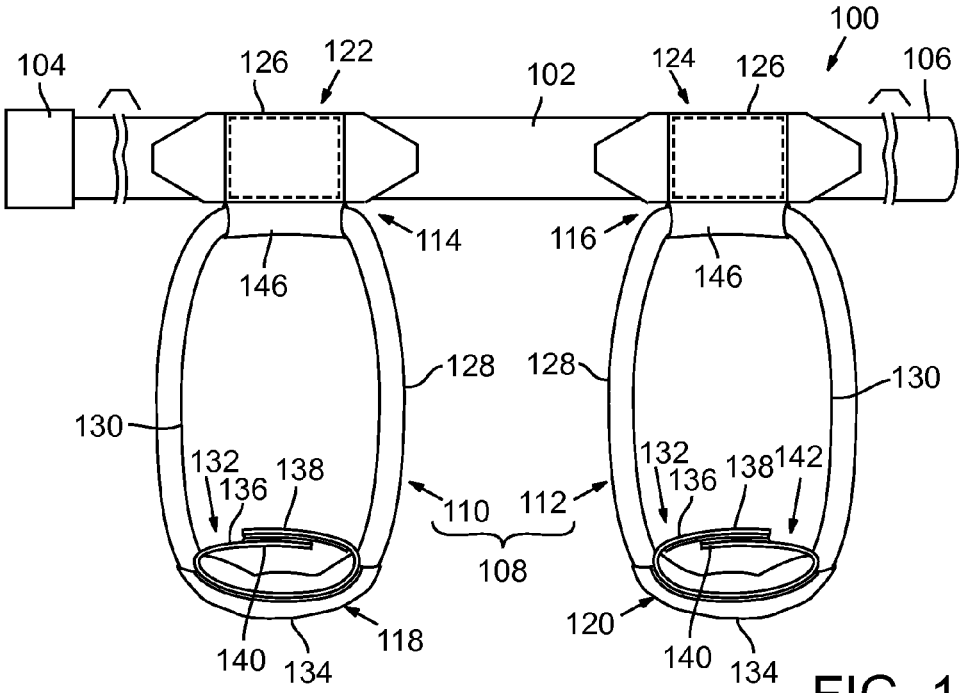
FIG. 1 is a side elevation view of the fitness device according to one embodiment with the waist belt extended to lay flat and showing the leg assembly of two leg resistance members.

FIG. 1 is a side elevation view of a fitness device 100 according to one embodiment as it would appear if stretched end to end or laid flat. The fitness device 100 includes a waist belt 102 and a leg loop assembly 108 that extends from the waist belt 102. In the illustrated implementation, there are first and second resilient leg loop members 110, 112 that are movably anchored along the waist belt 102. In the illustrated implementation, each leg loop member is independently movable along the waist belt 102.

Figure 2:
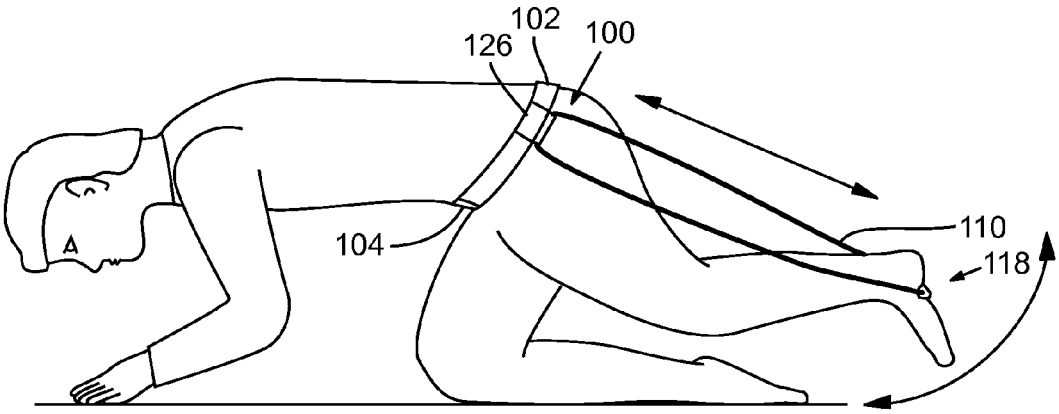
FIG. 2 is a schematic side elevation view of the fitness device of FIG. 1 as worn by the user and in use to perform an exercise.

As shown in FIG. 2, which is a schematic depiction of a user using the fitness device 100, the user has fastened the waist belt 102 around her waist by passing a free end 106 through a buckle 104. Depending upon the specific exercise being performed, and whether the fitness device is provided with one or two leg loop members, the user then positions the loop member(s) as desired and engages it.

As shown in FIG. 2, only the leg loop member 110 is present, and the user has prepared for the selected exercise by kneeling on her right knee and supporting her body with her arms. The user has engaged her left foot in the leg loop member 110 and then extended it against the resistance developed in the leg loop member 110 between the anchor point on the belt 102 and a distal end positioned near or on the user's foot. Repeatedly extending and retracting the leg, and/or lifting the extended leg, as shown generally by the arrows, are examples of two representative exercises to strengthen the user's muscles and tone the body, including the gluteus and other lower body muscles.

Figure 3:
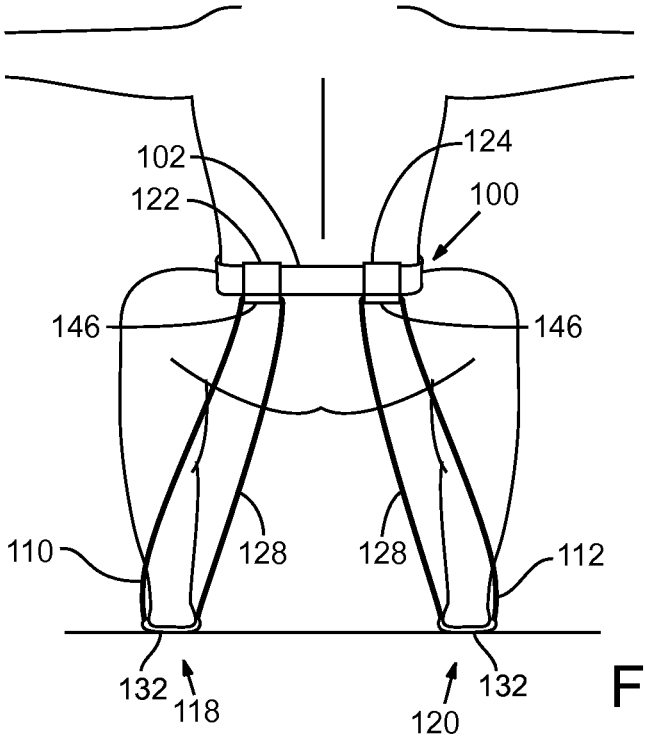
FIG. 3 is a schematic rear elevation view of the fitness device of FIG. 1 as work by the user and showing the approximate position of the leg resistance members as positioned for a selected exercise.

FIG. 3 is a schematic view of the user, shown from the rear and in a standing but crouched position, preparing to complete a different exercise with the fitness device 100. In the FIG. 3 example, the user has the leg loop member 110 engaged with the left foot and the leg loop member 112 engaged with the right foot. The leg loop members 110, 112 have their proximal ends 114, 116 positioned at anchor points 122, 124, respectively, along the belt 102. In some embodiments, and as described elsewhere in further detail, the anchor points are movable along the belt to position the leg loop members 110, 112 for proper execution of the selected exercise and the user's comfort, as well as to accommodate users of different sizes.

Referring again to FIG. 1, in a specific implementation, a first proximal end 114 of the first leg loop member 110 is shown to be coupled to the belt 102 at the anchor point 122 with a belt loop member 126. Similarly, a second proximal end 116 of the second leg loop member 112 is coupled to the belt 102 at the anchor point 124 with another belt loop member 126. Of course, it is possible to couple the leg loop members 110, 112 to the belt 102 in different ways.

The leg loop members 110, 112 comprise a resistance member 128 (or at least a length of resistance material). In the illustrated implementations, the resistance member 128 is formed to have a loop, and also may have an optional junction 130. The resistance member 128 is formed of a resilient material or is otherwise configured to provide resistance, at least when extended (in tension). Suitable materials for the resistance member 128 include latex, rubber and other natural and synthetic materials. The materials can be provided in any suitable shape, such as a tubular shape as shown or as a solid cord or flat member, as just some examples. The material and its dimensions can be selected to develop a desired resistance force range for a user of a given size.

In the illustrated implementation, the loop of the leg loop member 110, for example, extends from its proximal end 114 to its distal end 118. Conveniently, a loop of this size can extend under tension to run along the outside of the user's extended leg, around her foot region and back along the inside of her leg. In this way, exercises can completed over a full range of the user's motion and the leg loop member does not undesirably impinge against the user's body. With the leg loop member 110 positioned at the sides of the leg rather than along the front or back of the leg, there is only incidental contact between the leg loop member 110 and the user's leg as the leg is moved through its cycle, which makes the exercise effort more even and reduces chaffing or other similar effects from direct contact between the leg and an elastic member being repeatedly loaded and unloaded.

It is also possible to configure the exercise device to have leg loop members with straight sections extending from the belt and terminating in smaller loops. Such smaller loops are sized to accommodate at least the user's feet. In addition, it is also possible in some implementations to have two leg loop members extend from a single anchor point on the belt. In some cases, the final configuration may affect which exercises can be performed and the useful range of the device.

As shown in FIGS. 2 and 3, the fitness device can be used by simply engaging at least one foot, e.g., around the midsection of the foot, with the respective leg loop member 110 or 112. As shown for the specific implementation of FIG. 1, however, the fitness device 100 can have a foot piece 132 on each of the leg loop members 110, 112 for securing it to the respective foot, particularly when the leg is relaxed from its extended position. As illustrated, the foot piece 132 includes a body 134 and an adjustable strap 136 with overlapped first and second ends 138, 140, respectively, that are secured together, e.g, by hook and loop fasteners 142. The body 134 can have a tubular construction that keeps it secured to the respective leg loop member 110 or 112 but allows it to be slid into position as desired.

Figure 4:
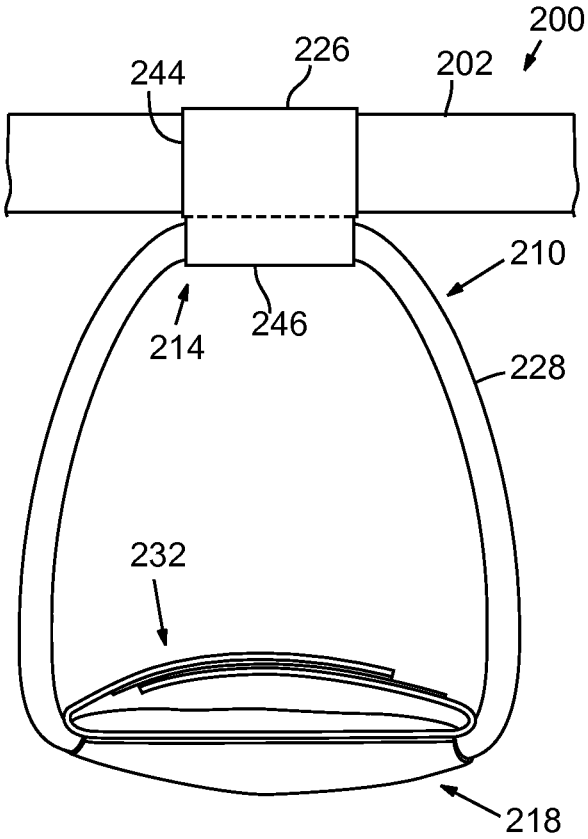
FIG. 4 is an elevation view of the fitness device according to another embodiment that can have one or two leg resistance members.

FIG. 4 is a side elevation view of a fitness device 200 according to another implementation. The fitness device 200 is similar to the fitness device 100, but includes only a single leg loop member 210, and the belt loop member 246 is slightly modified. For convenience, the components of fitness device 200 are identified with reference numerals of the corresponding components of the fitness device 100, plus 100.

Figure 5:
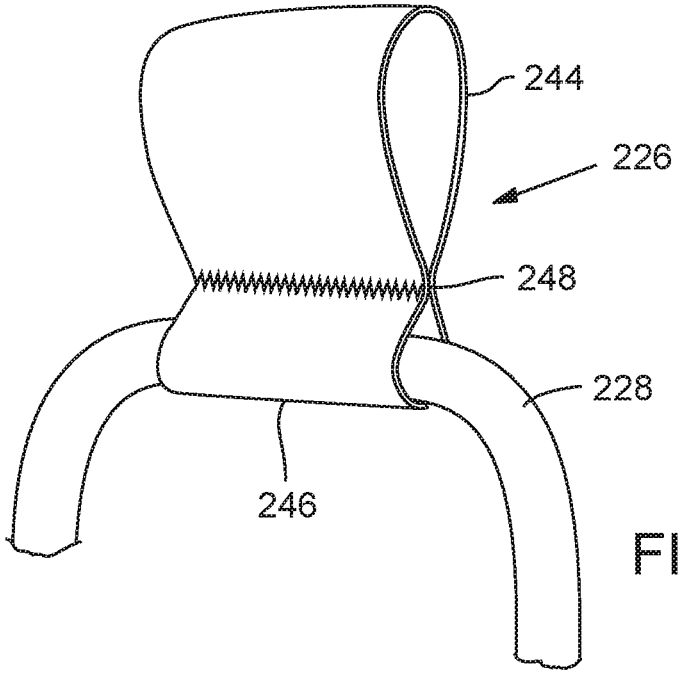
FIG. 5 is a perspective view showing a portion of a leg resistance member with a belt loop type attachment for attaching the leg resistance member to the waist belt.

FIG. 5 is a perspective view of a belt loop member 226 showing a portion of a resistance member 228 passing through a resistance member channel 246 that is formed in the belt loop member 226. The belt loop member 226 can be formed of a loop of material, such as from webbing or other suitable material. As shown, there is a separate belt channel 244 sized for sliding over the belt 202 (FIG. 4). As illustrated, the belt channel 244 can be separated from the resistance member channel, such as by a seam 248. Alternatively, the belt could be fitted with clips to receive the resistance members, or the resistance members could be directly connected to the belt.

Figure 6:
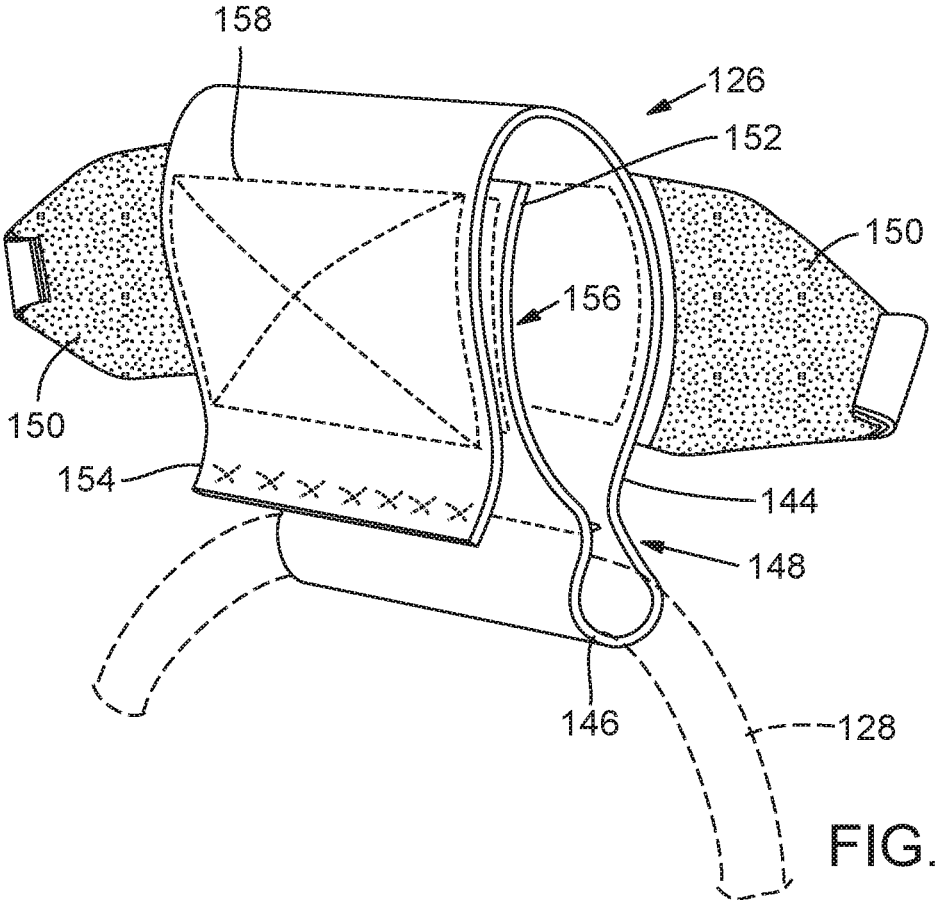
FIG. 6 is a perspective view of showing a portion of a leg resistance member with another belt loop attachment.

FIG. 6 is a perspective view of the belt loop member 126 shown in a slightly exploded state to illustrate details of the construction. A portion of the resistance member 128 is shown passing through a resistance member channel 146. There is also a separate belt channel 144 separated by a seam 148 from the resistance member channel 146. An inner end 152 and an outer end 154 of material are overlapped to form a loop. A resulting area of overlap 156 is reinforced, such as with stitching 158. In the belt loop member 126, there are optional wing portions 150 extending from either side. In some implementations, the wing portions can have attached hook and loop fastener material to keep the belt loop member 126 temporarily in place at a desired location along the belt.

Leg loop members having different sizes or providing for different resistance forces may be substituted. For example, a user can simply unfasten the belt 102, remove the current belt loop member 126 and thread on a substitute belt loop member with an attached leg loop member of a different size or resiliency.

Figure 7:
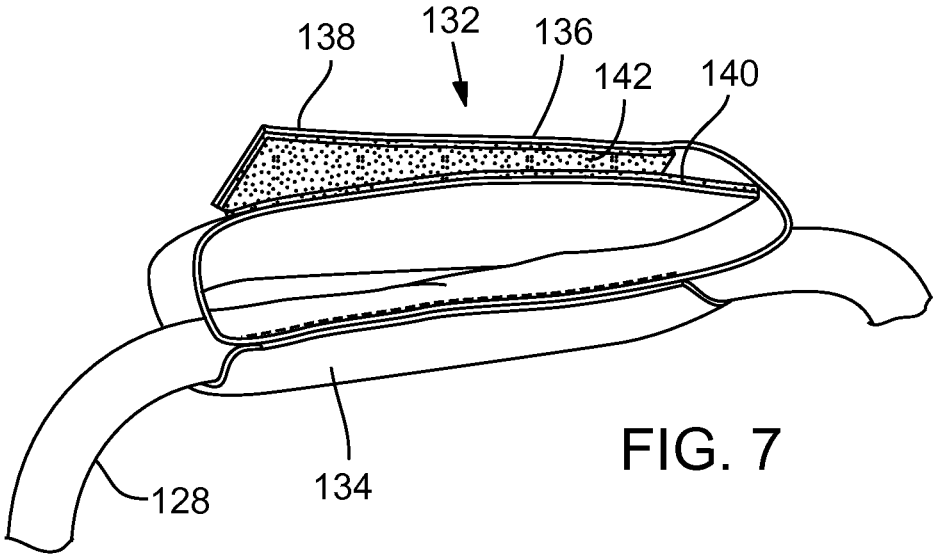
FIG. 7 is a perspective view of a foot piece.
Figure 8:
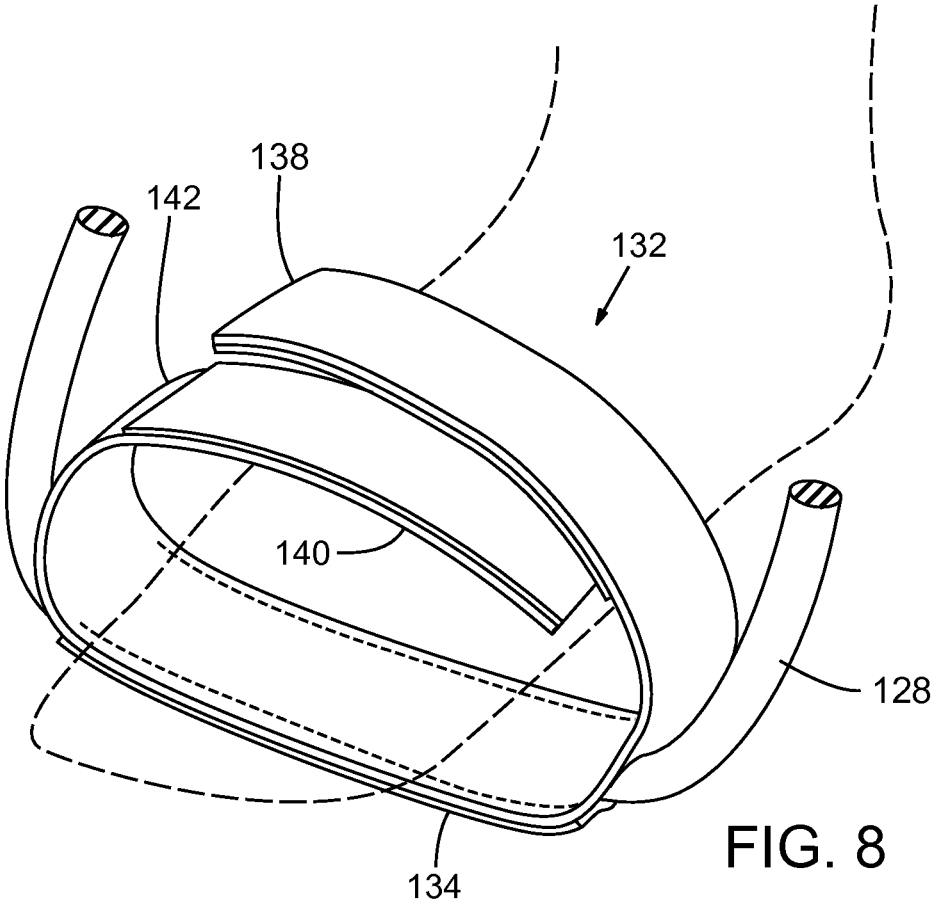
FIG. 8 is a perspective view of another foot piece as positioned around the user's foot.

FIG. 7 is a perspective view of the foot piece 132, which shows the overlapping ends 138, 140 of the strap 136 and how they are secured together from another angle. FIG. 8 is yet another perspective view of the foot piece 132 as arranged around the user's left foot.

Figure 9:
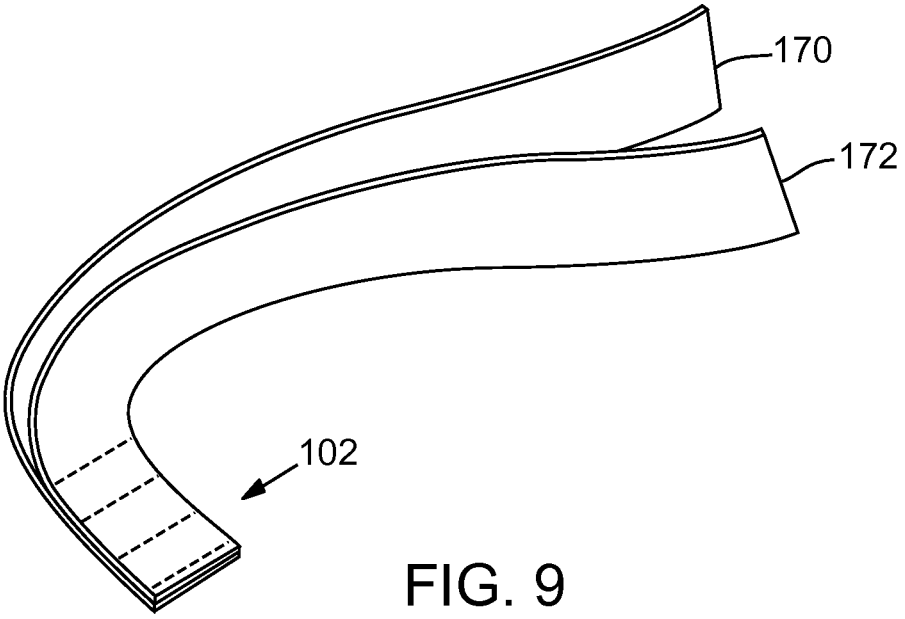
FIG. 9 is a perspective view of a portion of the belt showing an implementation with a multi-layer construction.

FIG. 9 is a perspective view of a portion of the belt 102 showing an implementation having an optional multi-layer construction. As shown, a first layer 170 of a webbing material is aligned and attached to a second layer 172, such as with stitching, to ensure that the device has sufficient strength and durability.

In some implementations, such as when the gluteus muscles are the target of the exercise, the anchor points 122, 124 are positioned so that the line of action of the resistance members 128 extends along the approximate midline of the buttock, roughly as shown in FIG. 2. This position of the anchor point(s) can also be described as at least slightly posterior of the user's midplane, or at a rear of the user. In the FIG. 1 and FIG. 4 embodiments, such positioning is achieved accomplished by sliding each belt loop member 126 or 226 as desired along the length of the belt, such as to the position shown in FIG. 2. Positioning the anchor points correctly and maintaining them throughout the exercise is important, and the belt with movable anchor points makes otherwise inconvenient or impossible resistance member directions achievable, especially when the user is unable to use her hands to hold or to adjust the resistance member. For other exercises, the anchor points can be adjusted accordingly to achieve the desired line of action or "pull" with the respective resistance members.

Although the belt 102, 202 has been described as a waist belt, it is noted that the belt can be adjusted to allow it to be worn above the waist or below the waist, such as in the area of the user's hips.

In view of the many possible embodiments to which the disclosed principles may be applied, it should be recognized that the illustrated embodiments are only preferred examples and should not be taken as limiting in scope. Rather, the scope of protection is defined by the following claims. We therefore claim all that comes within the scope and spirit of these claims.

We claim:

1. A fitness device, comprising:

a belt configured to fit around a user's waist;

a continuous leg loop member formed of a resilient material and having its ends affixed together; and a belt loop member comprising flexible strip material formed in a loop and having overlapped ends that are sewn together to define an overlapped region, reinforcement stitching in the overlapped region and a seam stitched through multiple layers of the strip material and defining a first tubular section dimensioned to slide over an end of the belt and an adjacent second tubular section sized to securely receive the continuous leg loop member, wherein the continuous leg loop member has a proximal end received in the second tubular section of the belt loop member and non-removably coupled to the belt loop member by the looped strip material and the seam, wherein the second tubular section has opposing ends with first and second openings, the first and second openings being separated by a width, a first portion of the continuous leg loop member extending from the first opening and defining a first resistance segment and a second portion of the continuous leg loop member extending from the second opening and defining a second resistance segment, the width being selected to assist the continuous leg loop member in forming an open loop shape at rest with spaced apart first and second portions to allow ready access by the user and to assist in positioning the first and second portions along opposite sides of the user's leg from a posterior of the belt to maintain a spaced apart relationship between the first resistance segment and the second resistance segment during use as the user's leg is bent and extended, and wherein the first and second portions of the continuous leg loop member are defined to intersect each other at a distal end of the continuous leg loop member, the distal end of the continuous loop member being shaped to pass under the user's foot and having a foot piece, the foot piece being non-removably coupled to the continuous leg loop member and having overlapping ends that can be secured together to retain the continuous leg loop member in contact with a midsection of the user's foot as the continuous leg loop member is tensioned and de-tensioned.

2. The fitness device of claim 1, wherein the belt loop member has at least one extension tab, and wherein the extension tab comprises one part of a hook and loop fastening arrangement and the belt comprises the other part of the hook and loop fastening arrangement, whereby the extension tab can be reversibly secured to the belt by the hook and loop fastening arrangement to keep the belt loop member in place along the length of the belt.

3. The fitness device of claim 2, wherein the extension tab extends in the belt direction beyond the second tubular section.

4. The fitness device of claim 1, wherein the belt loop member is a first belt loop member and the continuous leg loop member is a first continuous leg loop member, and further comprising a second belt loop member and a second continuous leg loop member extending through the second tubular section of the second belt loop, and wherein the first belt loop member and the second belt loop member are independently positionable relative to each other.

5. The fitness device of claim 1, wherein the continuous leg loop member is formed of a length of surgical tubing.

6. The fitness device of claim 1, wherein the continuous leg loop member cannot be removed from the second tubular section of the belt loop without severing the continuous leg loop or the second tubular section.

7. The fitness device of claim 1, wherein the continuous leg loop member has a tubular cross section.

8. The fitness device of claim 1, wherein the continuous leg loop member comprises tubing made of a synthetic material.

9. The fitness device of claim 1, wherein the foot piece is repositionable along the length of the continuous leg loop member.

10. The fitness device of claim 1, wherein the second tubular section of the belt loop member is directly adjacent the first tubular extension, the second tubular section being positioned to extend downwardly from the belt when the belt is worn by the user.

11. A leg loop and belt loop member for use with a fitness device having a belt, comprising:

a continuous leg loop member formed of a resilient material and having its ends affixed together; and a belt loop member comprising flexible strip material formed in a loop and having overlapped ends that are sewn together to define an overlapped region, reinforcement stitching in the overlapped region and a seam stitched through multiple layers of the strip material and defining a first tubular section dimensioned to slide over an end of the belt and an adjacent second tubular section sized to securely receive the continuous leg loop member, wherein the continuous leg loop member has a proximal end received in the second tubular section of the belt loop member and non-removably coupled to the belt loop member by the looped strip material and the seam, wherein the second tubular section has opposing ends with first and second openings, the first and second openings being separated by a width, a first portion of the continuous leg loop member extending from the first opening and defining a first resistance segment and a second portion of the continuous leg loop member extending from the second opening and defining a second resistance segment, the width being selected to assist the continuous leg loop member in forming an open loop shape at rest with the first and second portions spaced apart to allow ready access by a user and to assist in positioning the first and second portions along opposite sides of the user's leg to maintain a spaced apart relationship between the first resistance segment and the second resistance segment during use as the user's leg is bent and extended, and wherein the first and second portions of the continuous leg loop member are defined to, intersect each other at a distal end of the continuous leg loop member, the distal end of the continuous loop member being shaped to pass under the user's foot and having a foot piece, the foot piece being non-removably coupled to the continuous leg loop member and having overlapping ends that can be secured together to retain the continuous leg loop member in contact with a midsection of the user's foot as the continuous leg loop member is tensioned and de-tensioned.

12. The leg loop and belt loop member of claim 11, wherein the belt loop member has at least one extension tab, and wherein the extension tab comprises one part of a hook and loop fastening arrangement and the belt comprises the other part of the hook and loop fastening arrangement, whereby the extension tab can be reversibly secured to the belt by the hook and loop fastening arrangement to keep the belt loop member in place along the length of the belt.

13. The leg loop and belt loop member of claim 12, wherein the belt loop member comprises first and second extension tabs extending from opposing first and second edges of the belt loop member.

14. The leg loop and belt loop member of claim 11, wherein the continuous leg loop member is capable of exerting a predetermined resistance force.

15. The leg hoop and belt loop member of claim 11, wherein the continuous leg loop member is sized to extend along an inside of the user's outstretched leg, around a midsection of the user's foot and back along an outside of the user's leg toward the belt thereby providing two segments of resistance.

16. The leg loop and belt loop member of claim 11, wherein the continuous leg loop member has a tubular construction.

* * * * *